US005256832A

United States Patent [19]

Miyake

[11] Patent Number: 5,256,832

[45] Date of Patent: Oct. 26, 1993

[54] BEAT DETECTOR AND SYNCHRONIZATION CONTROL DEVICE USING THE BEAT POSITION DETECTED THEREBY

[75] Inventor: Atsushi Miyake, Tachikawa, Japan

[73] Assignee: Casio Computer Co., Ltd., Tokyo, Japan

[21] Appl. No.: 870,589

[22] Filed: Apr. 17, 1992

[30] Foreign Application Priority Data

Jun. 27, 1991 [JP] Japan ..... 3-156790

[51] Int. Cl.[5] ..... G10H 7/00

[52] U.S. Cl. ..... 84/636; 84/612; 84/645

[58] Field of Search ..... 84/612, 636, 652, 668, 84/645

[56] References Cited

U.S. PATENT DOCUMENTS 4,566,362 1/1986 Kikumoto ..... 84/612
4,594,930 6/1986 Murakami ..... 84/612
4,694,724 7/1987 Kikumoto et al. ..... 84/612
5,054,360 10/1991 Lisle et al. ..... 84/645
5,062,097 10/1991 Kumaoka ..... 84/645 X

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

A reference start point RPS and a reference end point RPE for detecting a beat position $BP_n$ are set as a $BP_{n-1}+BT\pm DR$ on the basis of a beat interval BT obtained by user's guide tapping for a predetermined time, a predetermined deviation value DR and the detected last beat position $BP_{n-1}$. Thus, the crest value Lrp of an audio signal exceeding a predetermined threshold TH in the specified retrieval interval is obtained. Each beat position $BP_n$ is obtained on the basis of a reference point RS of the audio signal existing when the crest value is obtained. In reproduction of an audio signal by a DMTR, a MIDI clock is generated from the beat position and output to a MIDI sequencer, etc.

18 Claims, 7 Drawing Sheets

BEAT DETECTOR AND SYNCHRONIZATION CONTROL DEVICE USING THE BEAT POSITION DETECTED THEREBY

BACKGROUND OF THE INVENTION

1. Field of the Invention

The present invention relates to a detector which extracts a beat position from an audio signal such as a tone signal, for example, obtained on the basis of a musical instrument played by a performer.

The present invention also relates to a synchronization control device which controls the synchronization of a musical instrument control device such as a MIDI (Musical Instrument Digital Interface) sequencer on the basis of the extracted beat position.

2. Description of the Related Art

Conventionally, when a musical instrument control device such as a MIDI sequencer and a recording and reproducing device such as an analog multitrack recorder are synchronized, precise speed control of the recording and reproducing device is impossible. Therefore, it is necessary to record a synchronization signal on a predetermined track of a recording medium in the recording and reproducing device and to provide synchronous control of a musical instrument control device on the basis of a synchronization signal reproduced from the recording and reproducing device.

Recently, a digital multitrack recorder (hereinafter referred to as "DMTR") is marked as a recording and reproducing device which uses a digital recording medium such as a hard disc which records digital data. In the DMTR, an analog audio signal obtained by a performer's performance is converted to digital audio signals at predetermined sample intervals and the digital audio signals are then recorded sequentially at successive addresses on a digital recording medium. Therefore, digital audio signals recorded at the respective addresses on the digital recording medium correspond accurately to a time elapsing from the start of recording using a clock from an oscillator as a reference. By operating the musical instrument control device in accordance with the clock from the DMTR, the musical instrument control device is easily and accurately synchronized with the DMTR.

For example, the DMTR generates an MIDI clock on the basis of a clock from its internal oscillator, and delivers it as an MIDI message to an MIDI sequencer, which provides automatic performance control over an electronic musical instrument or the like in accordance with the MIDI clock. The performer plays his own musical instrument to that automatic performance. An audio signal obtained by the performer's performance is recorded on the DMTR. In reproduction, the DMTR delivers to the MIDI sequencer the same MIDI clock as that in recording while reproducing a recorded audio signal. Thus, the reproduction of the audio signal and automatic performance of the musical instrument by the MIDI sequencer are synchronized accurately.

Some persons want to reproduce an audio signal recorded already in the recording and reproducing device while synchronizing automatic performance of the instrument by the MIDI sequencer with the reproduction. In such a case, the MIDI sequencer is required to be synchronized with the tempo of the reproduced audio signal. The tempo of the audio signal can vary depending on the performance of the instrument by the performer which has caused that audio signal to be generated. Thus, it is required to extract a beat position from the audio signal and to produce an MIDI clock on the basis of the beat position.

A conventional example of extracting a beat position from an audio signal is a system in which the user inputs data on a beat position by a manual operation. In this system, the user beforehand reproduces an audio signal from the recording and reproducing device while tapping predetermined input keys to the tempo of the audio signal. By this operation, information on the reproducing positions of the audio signals reproduced at the respective points of time when the input keys are tapped are recorded sequentially as the beat positions in a memory. In actual synchronous reproduction, the recording and reproducing device reproduces an audio signal while producing an MIDI clock at each of the timings obtained by dividing into a predetermined number of subintervals the interval from a reproduction position where the beat position exists to a reproduction position where the next beat position exists.

However, in the above conventional example, the user is required to listen the audio signal while performing the tapping operation without mistakes from the head of the audio signal to its end, so that he is required to have immense attentiveness and perseverance. He is forced to perform a long-time operation depending on the music. Thus, his fatigue and the probability of failure are high, and this system can not be said to be a practical one.

SUMMARY OF THE INVENTION

It is an object of the present invention to detect a beat position easily and accurately from an audio signal reproduced from a recording and reproducing device with a synchronization mechanism such as a DMTR and to provide accurate synchronous control of the musical instrument control device on the basis of the beat position.

A first aspect of the present invention involves a beat detector which detects the respective beat positions of an audio signal reproduced together with information on the reproduction positions of the respective reproducing timings from audio recording and reproducing means. The audio recording and reproducing means is, for example, a digital multitrack recorder (DMTR) which comprises disc storage means including, for example, different kinds of recording areas capable of recording thereon or reproducing therefrom different kinds of digital audio signals simultaneously and buffer memory means having a plurality of storage areas for recording or reproducing different kinds of digital audio signals into or from the disc storage device on a real time basis. It may be an analog multitrack recorder (AMTR) capable of outputting information on the reproduction position as a time recording signal, for example, for an SMPTE (Society of Motion Picture and Television Engineers).

According to the first aspect of the present invention, head beat position designating means is provided for causing the user to designate the head beat position in the audio signal. The designating means is a means for reading out, for example, a digital audio signal recorded in the DMTR, displaying it as an audio waveform on a display and causing the user to designate the head beat position with a mouse or the like.

Beat timing designating means is provided for causing the user to designate each beat timing while causing the audio recording and reproducing means to reproduce a predetermined interval of the audio signal. The timing designating means is, for example, an input key which the user is caused to tap.

Reference beat interval calculating mans is provided for calculating a reference beat interval of one beat from each beat timing designated by the user. The calculating means calculates a reference beat interval, for example, by dividing the above-mentioned predetermined interval by the number of times a user taps an input key.

Beat position detecting means is provided for detecting a reproduction position where a value related to the amplitude of the audio signal (for example, the amplitude itself) exceeds a predetermined threshold in a retrieval interval of a predetermined range the center of which is a reproduction position advancing by the reference beat interval from an already obtained beat position, using the head beat position as the initial value in the audio recorded in the audio recording and reproducing means, detecting the next beat position on the basis of the detected reproduction position, and so on. In place of a predetermined range the center of which is a reproduction position advancing by the reference beat interval from each beat position, the retrieval interval may be a predetermined range the center of which is a reproduction position advancing by an average beat interval directly before the already obtained beat position. In this case, the above-mentioned reference beat interval becomes the initial value. The beat position detecting means detects as the next beat position, for example, a reproduction position which is a predetermined offset position before the reproduction position detected in the retrieval interval. When the beat position detecting means cannot detect a reproduction position where the value related to the amplitude of the audio signal exceeds a predetermined threshold in the retrieval interval, the beat position detecting means detects the next beat position, for example, on the basis of a reproduction position advancing by the reference beat interval or average beat interval from the appropriate beat position.

A second aspect of the present invention involves a synchronization control device for synchronizing the operation of the musical instrument control device with the reproduction of an audio signal by the audio recording and reproducing means on the basis of each beat position detected by the beat detector as the, first aspect of the present invention.

According to the second aspect of the present invention, timing signal generating means is provided for generating a timing signal corresponding to each of timings at which an interval from each beat position to the next beat position is divided into equal subintervals while causing the audio recording and reproducing means to reproduce the audio signal. The timing signal generating means generates, for example, a timing signal for each interval while the timing signal outputting means is outputting a timing signal corresponding to a subinterval immediately before that subinterval.

Timing signal outputting means is provided for outputting a timing signal corresponding to each timing to the musical instrument control means. The outputting means outputs each timing signal, for example, as a MIDI message indicative of an MIDI clock. The same means outputs a start message as the MIDI message at the head beat position in the audio signal reproduced by the audio recording and reproducing means and outputs a stop message as the MIDI message at the last beat position.

In the beat detector according to the first aspect of the present invention, the beat position detecting means automatically detects the beat position of the audio signal recorded in the audio recording and reproducing means by determining a value on the amplitude of an audio signal indicative of a musical instrument tone, for example, in a rhythm system having a strong sense of beat among kinds of audio signals recorded in a plurality of storage areas in the audio recording and reproducing means and reproduced simultaneously from the storage areas.

In this case, a feature of the present invention is that a retrieval interval in which the next beat position is detected from an already obtained beat position is limited to only a predetermined range the center of which is a reproduction position which advances from a beat position immediately before the already obtained beat position by the reference beat interval calculated by the reference beat interval calculating means on the basis of the beat timing which the beat timing designating means caused the user to beforehand designate. By the user's designation of a beat timing which will be a reference only for a predetermined interval, as just described above, a probability of detection of a wrong beat position is greatly reduced in the automatic detection of subsequent beat positions.

If the retrieval interval is not determined at all times on the basis of the first reference beat interval, but determined on the basis of an average beat interval obtained for each beat position using the reference beat interval as the initial value, a change in the tempo depending on the advancement of performance can be well followed up. This average beat interval can be calculated from the interval between each beat position and another beat position which is a few beat positions before the former beat position.

If the retrieval in the retrieval interval fails, the next beat position is detected temporarily on the basis of a reproduction position which was the center of the retrieval interval, so that, for example, a missing beat position of a drum such as would occur because the drum is not beaten due to so-called "break" can be interpolated.

The synchronization control device as the second aspect of the present invention generates a timing signal corresponding to each of timings at which the interval between each beat position and the next beat position is divided into equal subintervals while causing the audio recording and reproducing means to reproduce an audio signal on the basis of each of the beat positions detected by the beat detector as the first aspect of the present invention as disclosed above, and outputs the generated timing signal as an MIDI clock to the musical instrument control device.

As a result, automatic performance is realized, for example, by the MIDI sequencer synchronized with the reproduction of an audio by the DMTR.

It will be obvious to those skilled in the art from the following description of preferred embodiments of the present invention that other structures, modifications and applications are possible in the present invention.

BRIEF DESCRIPTION OF THE DRAWINGS

Other objects and structures of the present invention will be understood by those skilled in the art from the following description of preferred embodiments of the present invention with respect to the accompanying drawings.

DETAILED DESCRIPTION OF THE PREFERRED EMBODIMENTS

Two embodiments of the present invention will be described hereinafter with reference to the drawings.

STRUCTURE OF DMTR

Figure 1:
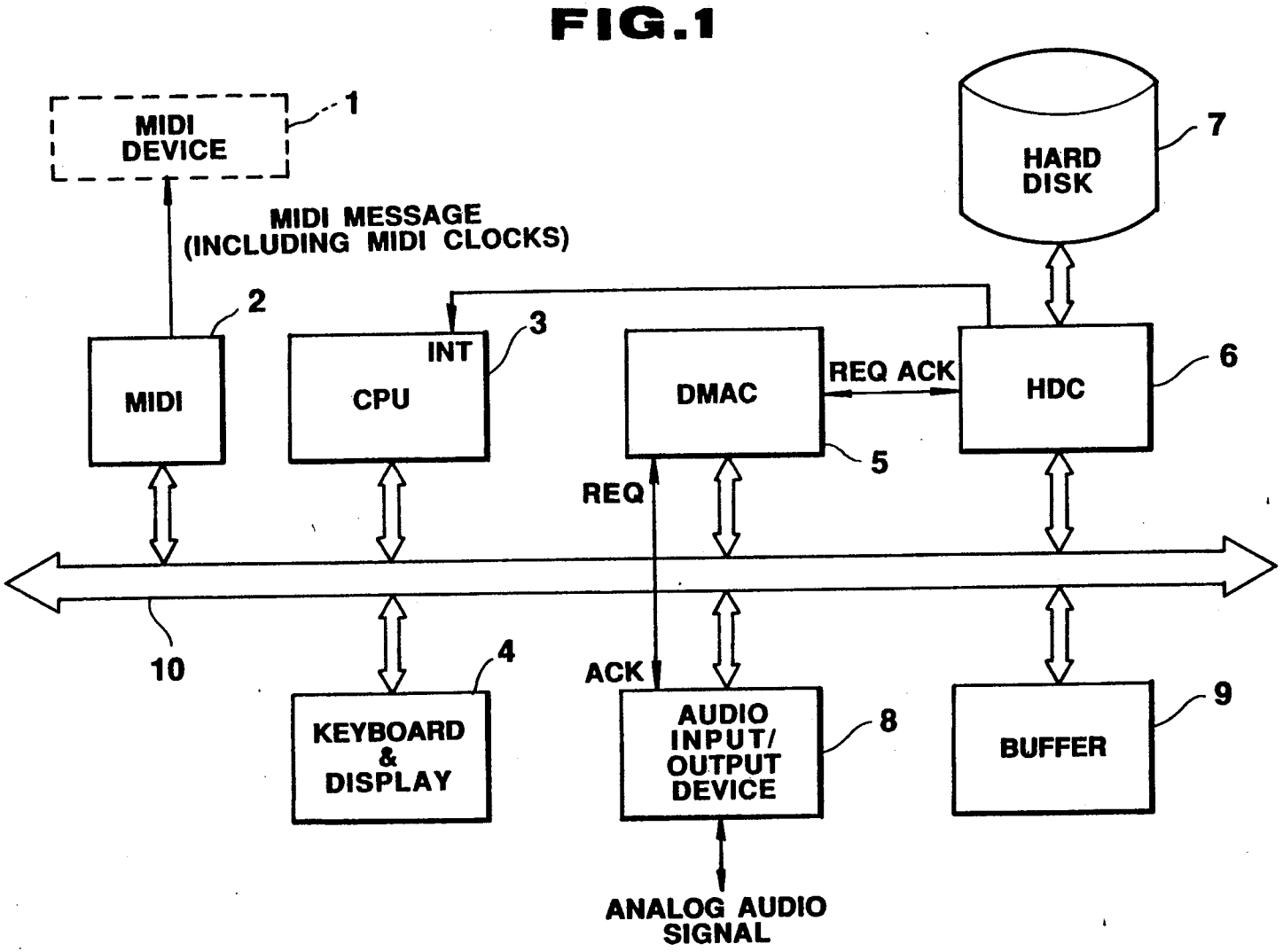
FIG. 1 shows the overall structure of a preferred embodiment of the present invention.

FIG. 1 is a block diagram indicative of the overall structure of a preferred embodiment of the present invention directed to a DMTR (Digital Multi-Track Recorder).

An audio input/output device 8 includes a plurality of parallel A/D converters, D/A converters and one-sample latches (not shown) which record and reproduce audio synchronously with sampling clocks, for a plurality of performance tracks in correspondence to the structure of a multi-track to be described later in more detail.

An analog audio signal based on a live performance is input to audio input/output device 8 where the respective performance parts of the signal are converted to digital audio signals by A/D converters (not shown) built in audio input/output device 8, temporarily written into a buffer 9 including a RAM through a bus 10, and then transferred to and recorded on a hard disc 7. In reproduction, a digital audio signal read out from hard disc 7 is temporarily written into buffer 9, converted to an analog audio signal in the D/A converters (not shown) in audio input/output device 8 and then output. The above operations are performed in parallel in correspondence to the structure of the multi-track.

Control over input/output of data into/from the hard disc 7 is provided by a hard disc controller (HDC) 6.

Control over data transfer between hard disc 7 and buffer 9 is provided by a DMAC (Direct Memory Access Controller) 5.

A CPU 3 provides the overall control including the start and end of the above data transfer and so forth. CPU 3 designates a performance track (to be described later in more detail) in the data transfer. Furthermore, CPU 3 detects time information on a beat to be described later in more detail, generates a MIDI clock on the basis of the time information, and outputs the MIDI clock as an MIDI message to an external MIDI device 1 through an MIDI 2.

As will be described in more detail later, a keyboard and display 4 is used for the user to input predetermined values thereinto while viewing the input waveform when the user determines a first beat position as a reference for beat detection and an attack offset.

The overall operation of the present embodiment will be described hereinafter.

OVERALL OPERATION OF DMTR

First, recording will be described.

Respective analog audio signals for a plurality of performance tracks (for example, 3 tracks) corresponding to a like number of performance parts or the like on the basis of a live performance input from outside are converted at each sample timing to one-sample digital audio signals in parallel by the plurality of A/D converters corresponding to the respective performance tracks in the audio input/output device 8 and are stored in a plurality of latches corresponding to the respective performance tracks in the audio input/output device 8.

Subsequently, when audio input/output device 8 outputs a transfer request signal REQ to DMAC 5 and DMAC 5 returns a transfer acknowledge signal ACK to audio input/output device 8, one-sample digital audio signals for a plurality of performance tracks stored in the respective latches in audio input/output device 8 are transferred through bus 10 to buffer 9 and written into storage ares for the respective performance tracks on the buffer 9 under control of DMAC 5.

In this way, when a predetermined number of samples (hereinafter referred to as "one block") of the digital audio signals for the plurality of performance tracks is written into buffer 9, CPU 3 outputs a data transfer instruction to HDC 6, which outputs a transfer request signal REQ to DMAC 5 and HDC 6 receives a transfer acknowledge signal ACK from DMAC 5. At this time, a one-block digital audio signal for the respective performance tracks written into buffer 9 is transferred under control of DMAC 5 through bus 10 to HDC 6, which then records the transferred digital audio signals on the storage areas of the respective performance tracks on hard disc 7.

In this case, data transfer from buffer 9 to HDC 6 is performed in units of a performance track. That is, CPU 3 first outputs to HDC 6 a transfer instruction for data on a first performance track. Thus, the one-block digital audio signal on the first performance track written in buffer 9 is recorded through HDC 6 on a storage area of a first performance track of hard disc 7. When data transfer for one block of the first performance track ends, HDC 6 outputs an interrupt signal INT to CPU 3. In response, CPU 3 outputs a transfer instruction of data for a second performance track. In this way, the digital audio signals for the respective performance tracks are sequentially transferred in units of a block from buffer 9 to hard disc 7.

When audio input/output device 8 inputs to DMAC 5 a transfer request signal REQ at each sample timing in the course of data transfer from buffer 9 to hard disc 7, DMAC 5 stops the data transfer and returns a transfer acknowledge signal ACK preferentially to input/output device 8. Thus, witting a digital audio signal from audio input/output device 8 to buffer 9 at each sample timing is performed preferentially. When this writing ends, DMAC 5 reopens data transfer stopped so far from buffer 9 to HDC 6.

The time required for transfer of one-block digital audio signals for a plurality of performance tracks from buffer 9 through HDC 6 to hard disc 7 is shorter than the time required for one-block digital audio signals for the plurality of performance tracks to be written from audio input/output device 8 to buffer 9 (=a predetermined sample timing time). Thus, the respective analog audio signals for the plurality of performance tracks corresponding to the like of performance parts and so forth on the basis of a live performance input from outside can be recorded on large capacity hard disc 7 on a real time basis.

In the reproducing operation in which digital audio signals for the plurality of performance tracks are read out from hard disc 7 and output from audio input/output 8 as analog audio signals for the respective performance tracks, control reverse to that in the recording is provided.

That is, first, a data transfer instruction for a first performance track is output from CPU 3 to HDC 6, which then outputs a transfer request signal REQ to DMAC 5. When HDC 6 receives a transfer acknowledge signal ACK from DMAC 5, a one-block digital audio signal is written into a first performance track storage area on buffer 9 through HDC 6 and bus 10 from the first performance track storage area on hard disc 7 under control of DMAC 5. When transfer of the one-block data for the first performance track ends, HDC 6 outputs an interrupt signal INT to CPU 3. In response, CPU 3 outputs a data transfer instruction for a second performance track. In this way, similar writing operations are performed sequentially for the respective performance tracks.

When a transfer request signal REQ is input from audio input/output device 8 to DMAC 5 at each sample timing in the course of data transfer from hard disc 7 to buffer 9, DMAC 5 stops the data transfer and returns a transfer acknowledge signal ACK preferentially to audio input/output device 8. Thus, a one-sample digital audio signal stored on each performance track of buffer 9 is transferred at a respective sample timing to a latch corresponding to that performance track in the audio input/output device 8 through bus 10 under control of DMAC 5. The data in each latch is subjected to D/A conversion in the D/A converter corresponding to that performance track, and is reproduced as an analog audio signal for each performance track. When reproduction of the one-sample digital audio signal for that performance track ends, DMAC 5 reopens data transfer stopped so far from hard disc 7 to buffer 9.

Each time audio input/output device 8 converts a one-block digital audio signal for each performance track to an analog signal, CPU 3 instructs transfer of a one-block digital audio signal in another performance track, to be reproduced, from hard disc 7 to buffer 9.

By such reproduction, the respective digital audio signals for the plurality of performance tracks recorded in hard disc 7 are reproduced and output to the outside on a real time basis.

A great feature of the present embodiment is that CPU 3 detects a beat position from a digital audio signal of a performance part where a tone, for example, of a drum in which the beat component is strong is recorded. CPU 3 generates a MIDI clock on the basis of the detected beat position, and outputs the MIDI clock as a MIDI message from MIDI 2 to an external MIDI device 1, which is, for example, an MIDI sequencer which causes an electronic musical instrument or the like to perform an automatic performance synchronously with a MIDI clock extracted from the MIDI message to thereby realize synchronization of reproduction of an audio signal by the DMTR of FIG. 1 and performance of the electronic instrument.

BASIC PRINCIPLE OF DETECTING A BEAT POSITION

The basic principle of detecting a beat position from an audio signal on hard disc 7 as mentioned above will be described below.

If a human being hears, for example, a regular waltz or a march, he can securely catch three beats from the former and four beats from the latter and easily perform a tapping operation (which means lightly striking something with a slight sound) to those beats. In this case, the time at which each tapping is performed becomes a beat position. If this beat position is available, it is possible to play a musical instrument synchronously with that beat position. If the MIDI clock is synchronized with that beat position, for example, the MIDI sequencer can easily cause an electronic musical instrument or the like to perform an automatic performance synchronously with the MID clock.

It is difficult for a human being to tap for every portions of an audio signal to be reproduced, as described above in the above "DESCRIPTION OF THE RELATED ART".

Figure 3:
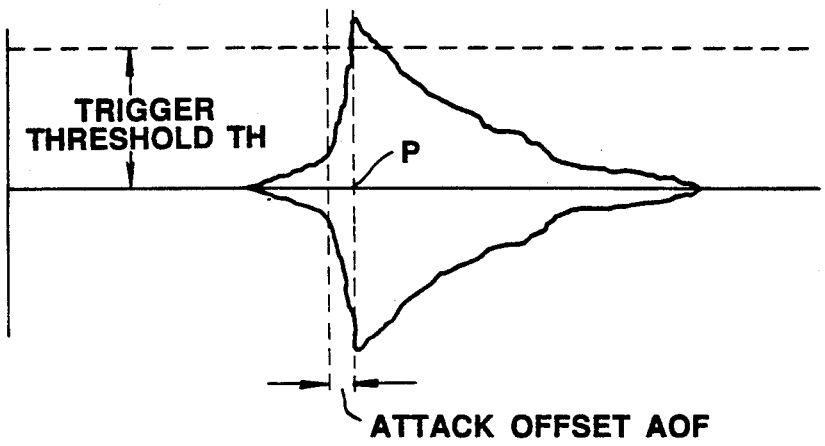
FIG. 3 illustrates an amplitude envelope of an audio signal.

It is very difficult to detect a beat position without the aid of a human being from an audio signal to be reproduced because in a regular melody a beat position is not necessarily present at the position of a peak of a sound volume. Even in a particular performance part such as a drum instrument having a marked beat component and a peak of the sound volume at a beat position, "break" can occur during performance or, for example, a rhythm tone other than an audio corresponding to a beat can become a peak of the sound volume. As a result, for example, as shown in FIG. 3, even if a beat is determined as existing at, or in the vicinity of, a position where a threshold (which is a trigger threshold TH to be described in more detail later) which is a predetermined amplitude level of the audio signal is exceeded, only such determination would produce many errors in the beat detection.

Therefore, the present embodiment uses both of guide tapping by the user to be described in more detail below and automatic detection of a beat position on the basis of the determination of the amplitude of the audio signal to be reproduced to detect a correct beat position.

The guide tapping means that the user listens to an audio signal of a bass drum or a snare drum remarkably containing beat components reproduced from the DMTR of FIG. 1 including a hard disc 7 while tapping predetermined keys several times on keyboard 4 to that beat.

The average time for one beat (between two adjacent beats) is calculated on the basis of such guide tapping, and handled as a reference time width (beat interval) for one beat.

CPU 3 examines a digital audio signal waveform on one performance track read out from hard disc 7 on the basis of the reference time width and automatically detects the timing of that beat.

The specified guide tapping control and auto beat detection will sequentially be described below. The signs indicative of respective parameters used in the description of each of the operation flowcharts below show the data in the respective registers in CPU 3.

GUIDE TAPPING CONTROL

Figure 2:
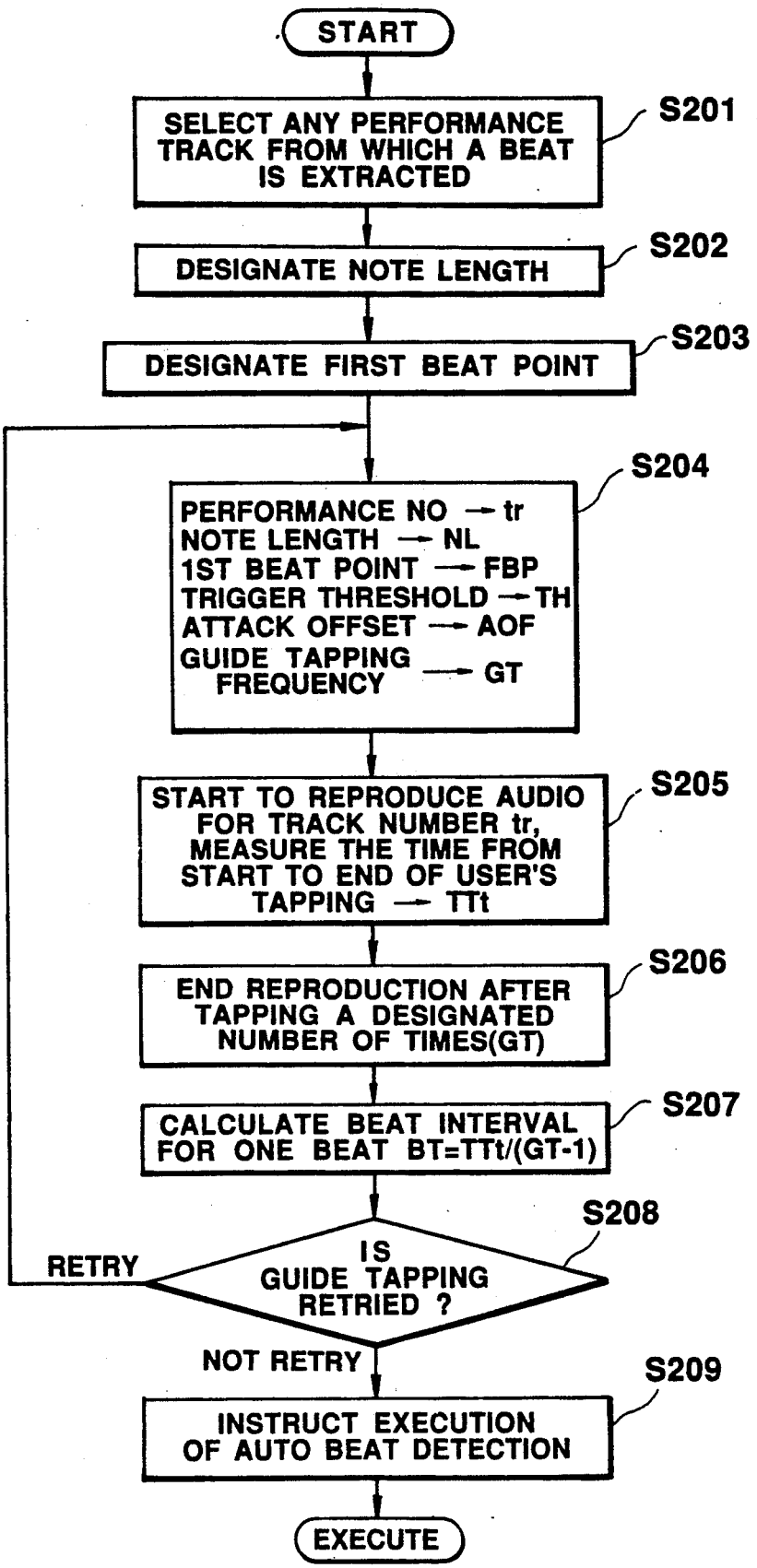
FIG. 2 is an operation flowchart indicative of guide tapping control.

FIG. 2 is a specified operation flowchart indicative of calculation of a one-beat interval by performing the guide tapping operation mentioned above. This flowchart is executed by CPU 3, which reads out into a memory (not shown) a control program stored in hard disc 7 or the like and executes the program.

First, CPU 3 causes the user to select a performance track containing a tone in a rhythm system from a performance track on hard disc 7 through keyboard 4 (step S201).

Next, CPU 3 causes the user to designate a note length (step S202). The note length is a value indicative of a note where guide tapping is performed. The user designates the note length; if he performs the guide tapping in a quarter note, he designates the note length as 4 and if he does in an eighth note, he designates the note length as 8, and so on.

CPU 3 then causes the user to designate a first beat point. For example, while CPU 3 is reproducing an audio signal, or while it is displaying an audio waveform on keyboard and display 4, it causes the user to designate an appropriate point through the keyboard (step S203). In this case, if any point is designated, absolute time data is obtained in hour, minute, second and frame in accordance with an address on hard disc 7 where the digital audio signal at that point is stored. This absolute time data indicates a recorded time from the head of each performance track on hard disc 7.

Then, various parameters are set. The number tr of the performance track selected by the user at step S201, the note length NL designated by the user at step S202, the absolute time data FBP at the first beat point (the first beat position) designated by the user at step S203, trigger threshold TH, attack offset AOF, and guide tapping frequency GT are set in the respective registers of CPU 3 (step S204). For example, as shown in FIG. 3, trigger threshold TH is a threshold for the amplitude of an audio signal determined in the auto beat detection to be described later in more detail. If in the auto beat detection the beat position or point of an audio waveform having an amplitude envelope such as that shown in FIG. 3 is set at a point P at which the amplitude envelope exceeds trigger threshold TH, the timing is too late as the beat point, so that the beat point is preferably set somewhat before point P. The offset value is an attack offset AOF. The note length NL is used in a MIDI clock generation process to be described later in more detail (see FIG. 7).

CPU 3 then starts to reproduce an audio signal designated with performance track number tr recorded in hard disc 7. The user performs the guide tapping to that reproduction. CPU 3 starts to measure a time TTt elapsing from the start of the tapping to its end (step S205). If the designated number of times GT of guide tapping is made, the reproduction ends (step S206).

CPU 3 divides the elapsed time TTt obtained by the above processing by (GT−1) to obtain the beat interval BT for one beat (step S207).

If the user instructs to retry guide tapping, CPU 3 returns to step S204 to iterate the above processing (step S208).

If no guide tapping is retried, the following ABD (Auto Beat Detection) is performed (step S209).

FIRST EMBODIMENT FOR AUTO BEAT DETECTION

Figure 4:
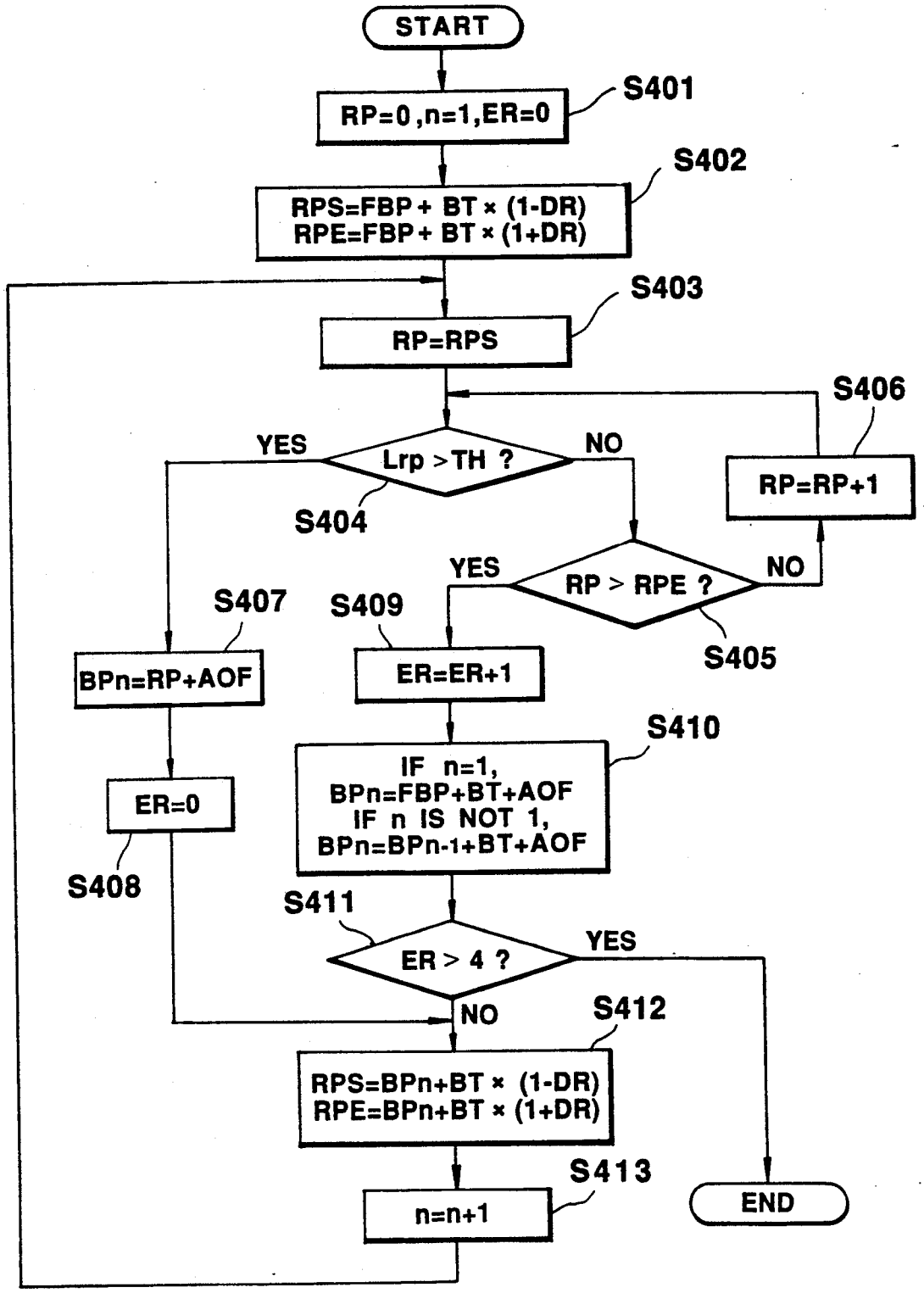
FIG. 4 is an operation flowchart indicative of a first embodiment of auto beat detection (ABD).

FIG. 4 is an operation flowchart indicative of a first embodiment for ABD. This flowchart is also realized by CPU 3, which reads a control program stored in hard disc 7 or the like into a memory (not shown) and executes it.

First, as initialization, the value of reference point RP which is a position where a digital audio signal accessed on a performance track with a number tr designated on hard disc 7 is sampled is set to 0, the value of a control variable n for the beat point is set to 1, and the value of an error flag ER (to be described later in more detail) is set to 0 (step S401).

As shown by expressions in step S402 of FIG. 4, reference start point RPS and reference end point RPE are set to respective values on the sums of first beat point FBP and a beat interval BT for one beat which allows for minus and plus deviation values DR (step S402). Reference start and end points RPS and RPE are time data corresponding to an address range in which a beat point next to first beat point FRB is retrieved on a performance track with a number tr on hard disc 7.

Next, reference point RP is set at the position of reference start point RPS (step S403).

Subsequently, the absolute value Lrp of the crest value of a digital audio signal corresponding to reference point RP is read out from a corresponding address on hard disc 7, and it is determined whether the absolute value Lrp is larger than trigger threshold TH or not (step S404).

If the determination is NO, control passes to step S405 where it is determined whether reference point RP exceeds reference end point RPE (step S405). If not, the value of reference point RP is incremented by one (step S406).

In this way, the loop processing including steps S404→S405→S406→S404 is iterated. Usually, the absolute value Lrp of the crest value at the reference point exceeding trigger threshold TH is obtained by the time when reference point RP exceeds reference end point RPE. At that time, the determination at step S404 becomes YES.

In this case, if the beat point is set to a point where trigger threshold TH is exceeded, the timing is too late, as mentioned above, so that the timing of an nth (this time, first) beat point $BP_n$ is advanced because attack offset AOF (value with a minus sign) set at step S204 of FIG. 2 is added to the current reference point RP (step S407).

In this way, beat point $BP_1$ subsequent to n=1, namely, first beat point FBR, is obtained and the value of error flag ER is reset to 0 (step S408). The error flag ER will be described in more detail later.

Next, detection of a second beat point $BP_n=BP_2$ is performed. In more detail, reference start and ed points RPS and RPE are set to values indicative of the respective sums of beat points $BP_{n-1}=BP_1$ detected this time plus beat intervals BT for one beat which allows for minus and plus deviation DR, as shown by expressions in step S412 similar to step S402 of FIG. 4 (step S412). Then, n is incremented by one (step S413). Control then returns to step S403 where reference point RS is set to a newly obtained reference start point RPS and the value of reference point RP is incremented (step S406) while retrieving reference point RS where the absolute value Lrp of the crest value exceeds trigger threshold TH between the new set reference start point RPS and reference end point RPE (loop processing at steps S404–S406). If reference point RS where Lrp exceeds TH is detected (determination at step S404 is YES), beat point $BP_n$ is detected as the value indicative of the sum of the current reference point RP and attack offset AOF (value with a minus sign) (step S407).

In this way, beat points $BP_n$ are sequentially detected.

While the above processing indicates that the absolute value Lrp of the crest value at reference point RP which exceeds predetermined trigger threshold TH has been detected at step S404, the reference point RP would pass through reference end point RPE and the determination at step S405 would become NO in the iteration of S404–S406 if the Lrp is not detected for the reason why the drum is not shot due to, for example, so-called "break". As long as such conditions continue, no beat point is detected, so that the beat point is determined as follows.

First, error flag ER is incremented by one (step S409).

Then, if n=1, the value indicative of the sum of first beat point FRB, beat interval BT and attack offset AOF is calculated as beat point $BP_n$. If n is not 1, the value indicative of the sum of beat point $BP_{n-1}$ immediately before the current beat point, beat interval BT and attack offset AOF is calculated as beat point $BP_n$ (step S410).

Thereafter, since the current error flag ER is 1, control passes sequentially to steps S411→S412→S403→S404. If absolute value Lrp of the crest value at reference point RP which exceeds predetermined trigger threshold TH is then detected, processing similar to that just mentioned is performed to thereby make the value of error flag ER 0. However, if absolute value Lrp of the crest value of such a reference point is not detected and the value of error flag ER is sequentially incremented in the processing at step S409 and its resulting value exceeds 4 (step S411), some error display is made to the user and auto beat detection is then stopped to thereby stop the processing forcedly. In this case, the user responds to this situation, for example, by changing the performance track from which auto beat detection is to be made.

By performing the series of processing operations, mentioned above, each beat point $BP_n$ (absolute time information) is obtained as the beat position of a digital audio signal to be reproduced from hard disc 7 and written into a RAM or the like (not shown) connected to hard disc 6 or bus 10.

SECOND EMBODIMENT FOR AUTO BEAT DETECTION

Figure 5:
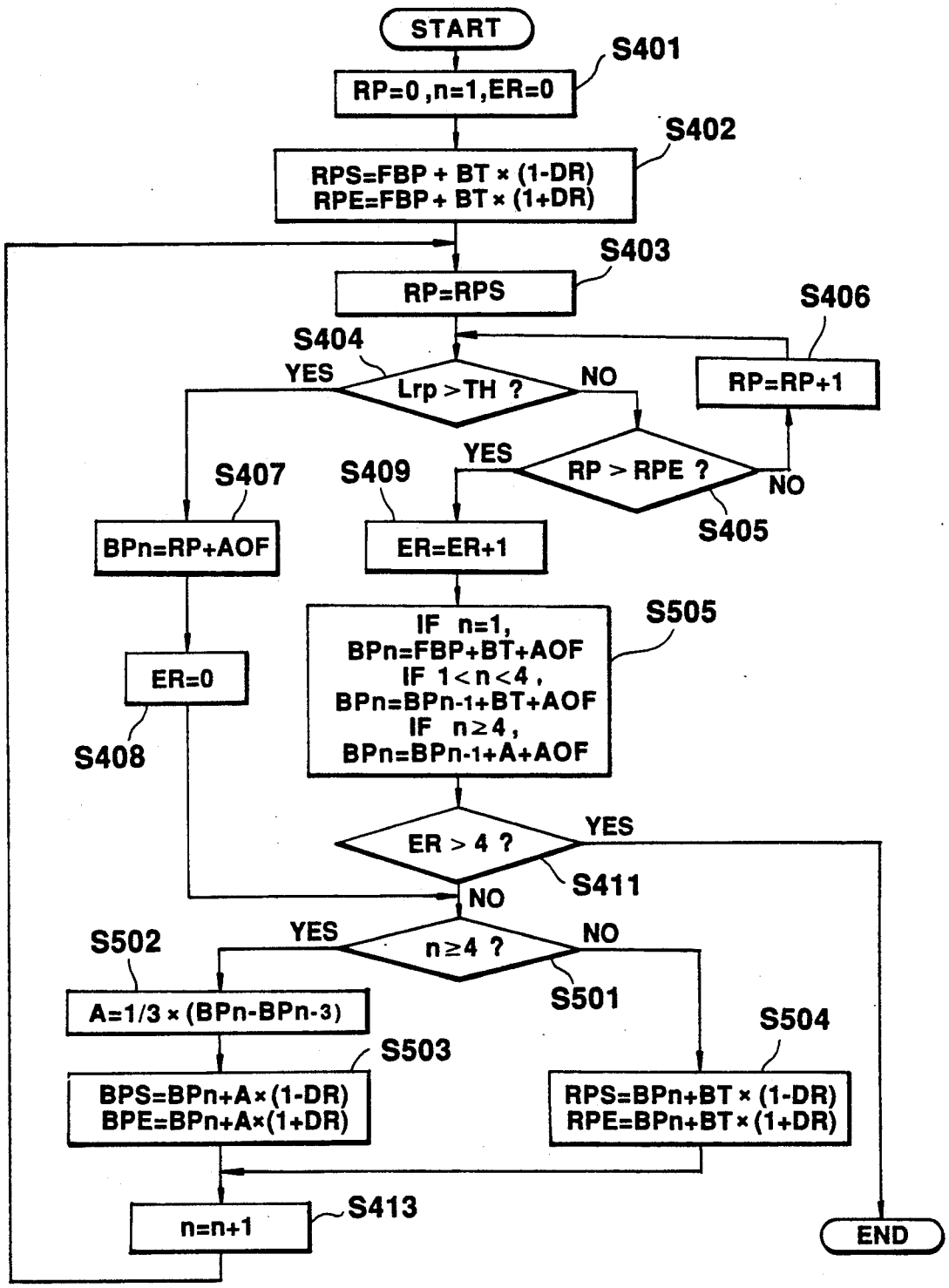
FIG. 5 is an operation flowchart indicative of a second embodiment of the ABD.

FIG. 5 is an operation flowchart of a second embodiment directed to auto beat detection (ABD) other than the first embodiment of FIG. 4. This operation flowchart is also realized by CPU 3, which reads a control program stored in hard disc 7 or the like into a memory (not shown) and executes the program, as in the first embodiment.

In the first embodiment of FIG. 4, beat point $BP_n$ was detected by an average beat interval BT for one beat obtained by guide tapping In actual performance, usually, its tempo varies during the performance due to the performer's feeling or degree of elation. In that case, of course, the beat count speed varies. When a performance track where an audio signal whose speed varies during performance is recorded is used in the auto beat detection, the beat point to be next detected can deviate from a reference range determined by {(beat point $BP_n$ detected this time)+-(average beat interval BT in guide tapping)±(deviation value DR)).

This is because the same beat interval BT is used at all times to determine the next reference range although the tempo varies during performance and the beat interval between adjacent beat points changes.

In the second embodiment, the average value of several (in the embodiment, three) beat intervals recently calculated is used as a beat interval used to determine a reference range to retrieve the next beat point. Thus, auto beat detection well following a change in the performance tempo is achieved. In this case, influence due to the performance tempo changing gradually is absorbed by deviation DR.

The operation of the second embodiment directed to auto beat detection (ABD) will be described using the FIG. 5 operation flowchart.

In FIG. 5, a step with the same reference number as in FIG. 4 performs exactly the same operation as that in the first embodiment of FIG. 4 and further description thereof will be omitted.

In the second embodiment, if the value of time control variable n is 4 or more (the determination at step S501 is YES), an average beat interval A for one beat is calculated from the time interval for the last three beats at step S502. At step S503, reference start and end points RPS and RPE are set to values indicative of the respective sums of beat point $BP_n$ detected this time and beat interval A for one beat which allows for minus and plus deviation value DR.

If the value of time control variable n is less than 4 (the determination at step S501 is NO), reference start and end points RPS and RPE are set to respective values of the respective sums of beat point $BP_n$ detected this time and beat interval BT for one beat in guide tapping and allowing for minus and plus deviation values DR at step S504.

In the processing at step S505 corresponding to the processing at step S410 of FIG. 4, if the value of time control variable n is 1, a value indicative of the sum of first beat point FBP, beat interval BT for one beat in the guide tapping and attack offset AOF is calculated as beat point $BP_n$. If $1<n<4$, a value indicative of the sum of beat point $BP_{n-1}$ immediately before the current beat point, beat interval BT for one beat in the guide tapping and attack offset AOF is calculated as beat point $BP_n$. If $n \geqq 4$, a value indicative of the sum of beat point $BP_{n-1}$ one beat point before the current beat point, average beat interval A for one beat calculated from the time interval for the last 3 beats at the last step S502, and attack offset AOF is calculated as beat point $BP_n$.

While at steps S503 and S505 the average of the beat intervals for the last 3 beats is used, the beat interval of a beat immediately before the last beat may be used instead.

OUTLINE OF GENERATION OF MIDI CLOCK

The auto beat detection of FIG. 4 or 5 described above relates to non-real time processing and the time difference between any adjacent beat points produced by this processing becomes a time interval for one beat. In the following MIDI clock generation, 24 MIDI clocks per note length corresponding to a quarter note are generated. These MIDI clocks are output as an MIDI message from MIDI 2 to external MIDI device 1.

For example, an MIDI sequencer as MIDI device 1 realizes synchronization of reproduction of an audio signal by the DMTR of FIG. 1 with performance of an electronic instrument by causing the electronic instrument or the like to perform automatic performance synchronously with the MIDI clock extracted from the MIDI message.

Figure 6:
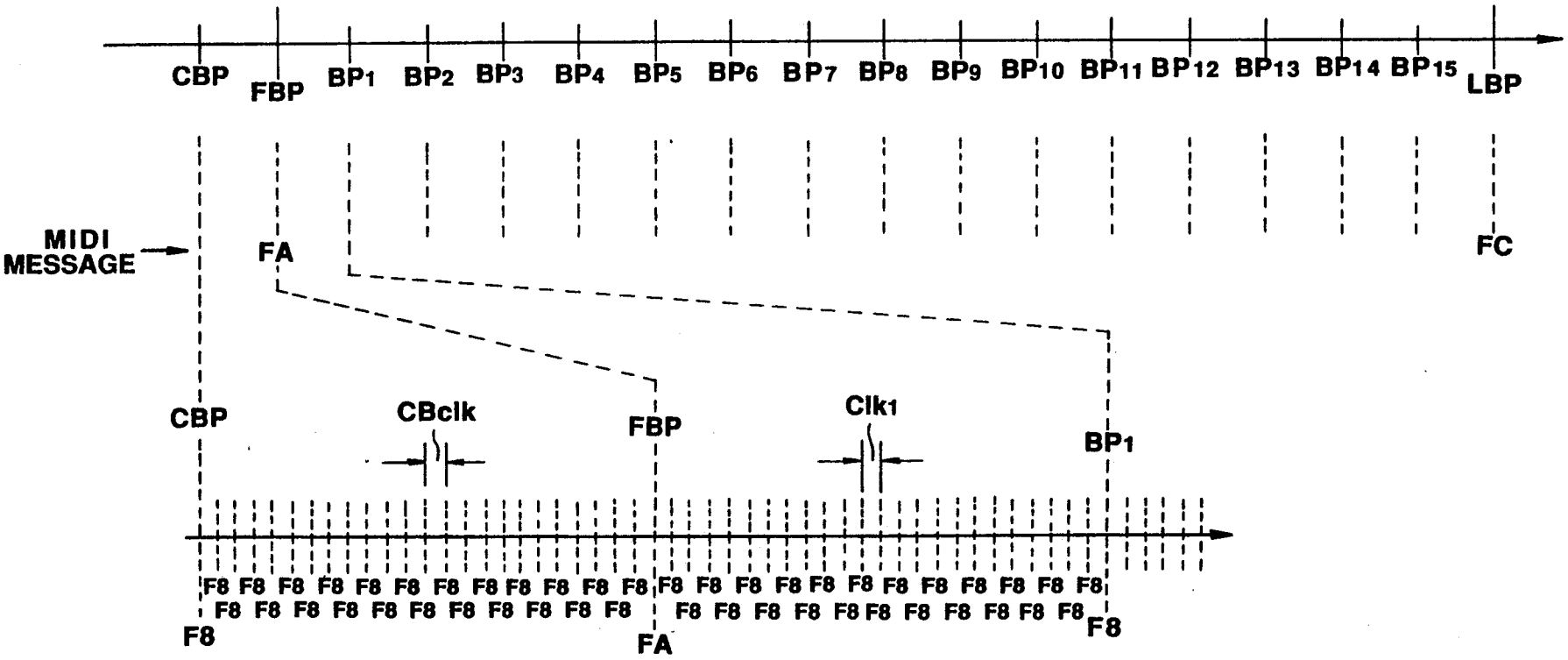
FIG. 6 shows the relationship between beat point and MIDI clock.

FIG. 6 illustrates the relationship between respective beat points $BP_n$ generated by auto beat detection and MIDI clocks. FIG. 6 also illustrates the case where the user has designated a value of 4 corresponding to the length of a quarter note as the note length NL at step S202 of the guide tapping control processing of FIG. 2, mentioned above.

A start message where its status byte is FA (hexadecimal notation) is sent at the time when synchronization by a MIDI clock starts or at a point of time for first beat point FBP of FIG. 6 when a MIDI clock is delivered on the basis of an MIDI standard. Subsequently, 24 timing clocks where the status byte for one beat is F8 are sent. At a point of time where synchronization by the MIDI clock ends or at the last beat point LBP of FIG. 6, an end message where its status byte is FC is sent.

MIDI device 1, for example, MIDI sequencer, starts automatic performance control when it receives the start message, and each time it receives a MIDI clock, generates a timing clock in the sequencer on the basis of that data and provides automatic performance control on the basis of the timing clock. The MIDI sequencer stops the automatic performance control when it receives an end message.

In the actual MIDI clock generation, MIDI clocks for a certain time (in the present embodiment, for one beat) are output before the start message is output, as shown in FIG. 6 such that MIDI device 1 such as the MIDI sequencer beforehand recognizes the interval between the adjacent MIDI clocks to start to provide synchronization control directly after the reception of the start message.

SPECIFIED OPERATION OF GENERATION OF A MIDI CLOCK

The specified operation of transmission of a MIDI message such as the MIDI clock to an external MIDI device using an operation flowchart of FIG. 7 will be described. This operation flowchart is realized by CPU 3, which reads the control program stored in hard disc 7, etc., into a memory (not shown) and executes the program. Signs indicative of respective parameters used in the following description of the operation flowchart show the data in the respective registers of CPU 3.

Figure 7:
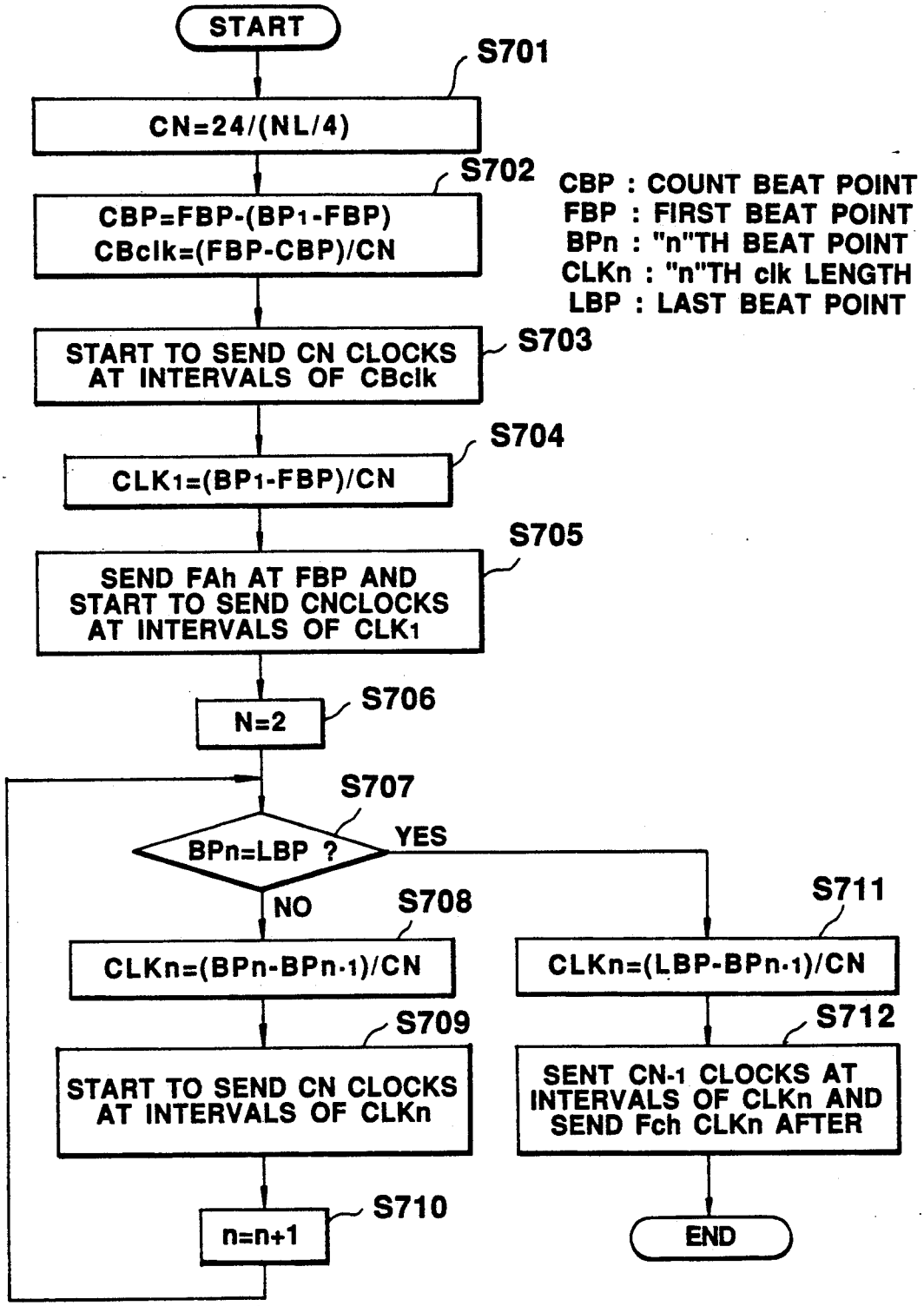
FIG. 7 is an operation flowchart indicative of the generation of an MIDI clock.

The operation flowchart of FIG. 7 is realized in the FIG. 1 DMTR synchronously with reproduction of the respective digital audio signals on performance tracks including a performance track recorded on hard disc 7 and where auto beat detection is beforehand executed.

First, the number of MIDI clocks CN sent at each beat interval is calculated (S701). As mentioned above, 24 MIDI clocks per note length corresponding to a quarter note are sent. Therefore, MIDI clocks the number CN of which is shown by the expressions in step S701 of FIG. 7 are sent for each note length NL for one beat in the guide tapping (see steps S202 and S204 of FIG. 2).

As mentioned above, in order to cause a MIDI clock to start to be output one beat before first beat point FBP, a count beat point CBP which is a beat point one beat before FBP is obtained to exist the same time interval as the time interval between FBP and BP1 before FBP, as shown by the first expression in step S702 of FIG. 7 (see FIG. 6). As shown by a second expression in step S702 of FIG. 7, the time between the resulting CBP and FBP is divided by CN using the CBP into the resulting equal time subintervals which are each a clock interval CBclk of the MIDI clock (step S702).

With count beat point CBP as the head position, CN MIDI clocks (for example, in a quarter note, 24 clocks) start to be sent with a status byte of F8 and a clock interval of CBclk (step S703). At this starting point, reproduction of a digital audio signal starts from an address corresponding to count point CBP on each performance track in hard disc 7.

Thereafter, by the time when first beat point FBP where the CN MIDI clocks are all sent arrives, the clock interval CLK1 in the next one beat time interval (BP1−FBP) is calculated as equal subintervals into which (BP1−FBP) is divided by CN (step S704).

Subsequently, at the timing of first beat point FBP, a start message the status byte of which is FA is sent and CN MIDI clocks then start to be sent at clock intervals of CLK1 (step S705). When each MIDI clock is sent, a digital audio signal at an address corresponding to the timing of sending a MIDI clock on each performance track in hard disc 7 is reproduced.

After the start message is sent at the time of FBP, time control variable n is set to n=2 (step S706), and steps S707–S710 for generating and sending MID clocks after beat point BP2 are iterated.

In this case, MIDI clocks start to be sent at clock intervals of $CLK_n$ directly after current beat point $BP_n$ at step S709, and CN MIDI clocks are sent between $BP_n$ and the next beat point, during which the value of variable n is incremented by one at step S710, The following clock interval $CLK_n$ is calculated at step S708. Simultaneously, a digital audio signal at an address corresponding to the timing of sending each MIDI clock on each performance track is reproduced from hard disc 7.

At step S707, when the next beat point $BP_n$ is determined as the last beat point LBP, the clock interval $CLK_n$ between $BP_{n-1}$ and LBP is calculated at step S711, and (CN−1) MIDI clocks are sent at clock intervals of $CLK_n$ at step S712. At the timing of last beat point LBP a clock interval $CLK_n$ after (CN−1) clocks are sent, a stop message the status byte of which is FC is sent (also, step S712) to terminate generation of the MIDI clocks. At this point of time, reproduction of a digital audio signal from hard disc 7 is also terminated.

While in the above described embodiment a beat position is detected as an address value on the hard disc with the use of the DMTR as a premise, the present invention is not limited to it. For example, the present invention is applicable to an analog multitrack recorder which can output a time record signal such as an SMPTE. In this case, the beat position is detected as a data value of the SMPTE signal. As the storage medium, various media such as magnetic tapes, optical discs, opto-magnetic discs, etc., can be used in addition to hard discs.

According to the inventive beat detector, the user can beforehand designate a beat timing which is a reference for only a predetermined interval, and automatically detect each beat position while specifying a retrieval interval on the basis of a reference beat interval calculated from the beat timing to thereby greatly reduce the probability of erroneous detection of a beat position in the automatic detection of the beat position.

Since a beat corresponding to the tempo changing depending on a musical expression by the performer can be detected, the synchronous performance can be made on the basis of a beat which is human and rich in music and not on a fixed beat as in a metronome.

In this case, since the user is required to designate a beat timing for a short predetermined interval, a load on the user is small.

By determining the retrieval interval not on the first beat interval at all times but on an average beat interval calculated for each beat position by using the reference beat interval as the initial value, automatic detection of a beat position well following a change in the tempo depending on the advancement of performance is achieved.

When retrieval in the retrieval interval fails, the next beat position should be temporarily detected on the basis of the reproduction position which is the center of the retrieval interval to thereby interpolate, for example, a missing beat position of a drum such as would occur because the drum is not beaten due to so-called "break".

As mentioned above, the inventive synchronization control device causes the audio recording and reproducing means to reproduce an audio signal while generating a timing signal synchronously with the reproduction of the audio signal on the basis of each of the beat positions detected from the inventive beat detector and outputting the timing signal, for example, as an MIDI clock to the musical instrument control device to thereby realize a synchronous operation of the audio recording and reproducing means and the musical instrument control device.

While the present invention have been described in detail with respect to several embodiments thereof, they are only for illustrative purposes and the present invention can have various structures. All changes, modifications and applications of the present invention fall within the scope of the present invention, which should therefore be determined only by the appended claims and their equivalents

What is claimed is:

1. A beat detector comprising:

audio recording and reproducing means for recording and reproducing an audio signal and including storage means for recording the audio signal;

head beat position designating means, operable by a user, for designating a head beat position in the audio signal recorded in said storage means;

beat timing designating means, operable by a user, for designating each beat timing for a predetermined interval of the audio signal while causing said audio recording and reproducing means to reproduce the audio signal;

reference beat interval calculating means for calculating a reference beat time interval for one beat from the beat timings designated by said beat timing designating means; and beat position detecting means for detecting each beat position on the basis of a reproduction position where a value related to the amplitude of the audio signal exceeds a predetermined threshold in a retrieval interval of a predetermined range the center of which is a reproduction position advancing by the reference beat interval from an already obtained beat position using the head beat position as an initial value in the audio signal recorded in said storage means.

2. A beat detector according to claim 1, wherein when said beat position detecting means is incapable of detecting the reproduction position where the value related to the amplitude of the audio signal exceeds the predetermined threshold in the retrieval interval, said beat position detecting means including means for detecting the following beat position on the basis of a reproduction position advancing by the reference beat interval from an appropriate beat position.

3. A beat detector according to claim 1, wherein said beat position detecting means including means for detecting as the next beat position a reproduction position which is a predetermined offset position before the reproduction position detected in the retrieval interval.

4. A beat detector according to claim 1, wherein said audio recording and reproducing means comprises;

disc storage means including a plurality of kinds of recording areas capable of recording thereto or reproducing therefrom a plurality of kinds of digital audio signals simultaneously; and buffer memory means including a plurality of storage areas for recording or reproducing the plurality of kinds of digital audio signals to or from said disc storage means on a real time basis.

5. A beat detector comprising:

audio recording and reproducing means for recording and reproducing an audio signal and including storage means for recording the audio signal;

head beat position designating means, operable by a user, for designating the head beat position in the audio signal recorded in said storage means;

beat timing designating means, operable by a user, for designating each beat timing for a predetermined interval of the audio signal while causing said audio recording and reproducing means to reproduce the audio signal;

reference beat interval calculating means for calculating a reference beat time interval for one beat from the beat timings designated by said beat timing designating means; and beat position detecting means for detecting each beat position on the basis of a reproduction position where a value related to the amplitude of the audio signal exceeds a predetermined threshold in a retrieval interval of a predetermined range the center of which is a reproduction position advancing from an already obtained beat position by an average beat interval which uses as an initial value the reference beat interval directly before the already obtained beat position, using the head beat position as an initial value in the audio signal recorded in said storage means.

6. A beat detector according to claim 5, wherein when said beat position detecting means is incapable of detecting the reproduction position where the value related to the amplitude of the audio signal exceeds the predetermined threshold in the retrieval interval, said beat position detecting means including means for detecting the following beat position on the basis of a reproduction position advancing from the already obtained beat position by an average beat interval using as an initial value the reference beat interval at the already obtained position.

7. A beat detector according to claim 5, wherein said beat position detecting means including means for detecting as the next beat position a reproduction position which is a predetermined offset position before the reproduction position detected in the retrieval interval.

8. A beat detector according to claim 5, wherein said audio recording and reproducing means comprises;

disc storage means including a plurality of kinds of recording areas capable of recording thereto or reproducing therefrom a plurality of kinds of digital audio signals simultaneously; and buffer memory means including a plurality of storage areas for recording or reproducing the plurality of kinds of digital audio signals to or from said disc storage means on a real time basis.

9. A synchronization controls device comprising:

audio recording and reproducing means for recording and reproducing an audio signal and including storage means for recording the audio signal;

head beat position designating means, operable by a user, for designating the head beat position in the audio signal recording in said storage means;

beat timing designating means for causing the user to designate each beat timing for a predetermined interval of the audio signal while causing said audio recording and reproducing means to reproduce the audio signal;

reference beat interval calculating means for calculating a reference beat time interval for one beat from the beat timings designated by said beat timing designating means;

beat position detecting means for detecting each beat position on the basis of a reproduction position where a value related to the amplitude of the audio signal exceeds a predetermined threshold in a retrieval interval of a predetermined range the center of which is a reproduction position advancing by the reference beat interval from an already obtained beat position, using the head beat position as an initial value in the audio signal recorded in said storage means;

musical instrument control means for controlling a musical instrument;

timing signal generating means for generating a timing signal corresponding to each of timings at which an interval from each beat position to the next beat position is divided into equal subintervals while causing said audio recording and reproducing means to reproduce the audio signal; and timing signal outputting means for outputting to said musical instrument control means a timing signal corresponding to said last-mentioned timings to thereby synchronize the operation of said musical instrument control means with the reproduction of the audio signal by said audio recording and reproducing means.

10. A synchronization control device according to claim 9, wherein said timing signal generating means including means for generating a timing signal corresponding to each of the timings at which the interval is divided into equal subintervals while said timing signal outputting means is outputting a timing signal corresponding to a subinterval immediately before the subinterval related to that timing signal.

11. A synchronization control device according to claim 9, wherein said timing signal outputting means includes means for outputting each timing signal as a MIDI message indicative of a MIDI clock.

12. A synchronization control device according to claim 11, wherein said timing signal outputting means includes means for outputting a starting message as a MIDI message at the heat beat position in the audio signal reproduced by said audio recording and reproducing means, and means for outputting a stopping message as a MIDI message at the last beat position.

13. A synchronization control device according to claim 9, wherein said audio recording and reproducing means comprises;

disc storage means including a plurality of kinds of recording areas capable of recording to or reproducing therefrom a plurality of kinds of digital audio signals simultaneously; and buffer memory means including a plurality of storage areas for recording or reproducing the plurality of kinds of digital audio signals to or from said disc storage mean on a real time basis.

14. A synchronization control device comprising:

audio recording and reproducing means for recording and reproducing an audio signal and including storage means for recording the audio signal;

head beat position designating means, operable by a user, for designating the head beat position in the audio signal recorded in said storage means;

beat timing designating means, operable by a user, for designating each beat timing for a predetermined interval of the audio signal while causing said audio recording and reproducing means to reproduce the audio signal;

reference beat interval calculating means for calculating a reference beat time interval for one beat form the beat timings designated by said beat timing designating means;

beat position detecting means for detecting each beat position on the basis of a reproduction position where a value related to the amplitude of the audio signal exceeds a predetermined threshold in a retrieval interval of a predetermined range the center of which is a reproduction position advancing from an already obtained beat position by an average beat interval which uses as an initial value the reference beat interval directly before the already obtained beat position, using the head beat position as an initial value in the audio signal recorded in said storage means;

musical instrument control means for controlling a musical instrument;

timing signal generating means for generating a timing signal corresponding to each of timings at which an interval from each beat position to the next bat position is divided into equal subinterval while causing said audio recording and reproducing means to reproduce the audio signal; and timing signal outputting means for outputting to said musical instrument control means a timing signal corresponding to each of said last-mentioned timings to thereby synchronize the operation of said musical instrument control means with the reproduction of the audio signal by said audio recording and reproducing means.

15. A synchronization control device according to claim 14, wherein said timing signal generating means includes means for generating a timing signal corresponding to each of the timings at which the interval is divided into equal subintervals while said timing signal outputting means is outputting a timing signal corresponding to a subinterval immediately before the subinterval related to that timing signal.

16. A synchronization control device according to claim 14, wherein said timing signal outputting means includes means for outputting each timing signal as a MIDI message indicative of a MIDI clock.

17. A synchronization control device according to claim 16, wherein said timing signal outputting means includes means for outputting a starting message as a MIDI message at the head beat position in the audio signal reproduced by said audio recording and reproducing means, and means for outputting a stopping message as a MIDI message at the last beat position.

18. A synchronization control device according to claim 14, wherein said audio recording and reproducing means comprises:

disc storage means including a plurality of kinds of recording areas capable of recording to or reproducing therefrom a plurality of kinds of digital audio signals simultaneously; and buffer memory means including a plurality of recording areas for recording or reproducing the plurality of kinds of digital audio signals to or from said disc storage means on a real time basis.

* * * * *